US007066299B1

(12) United States Patent
Fleming

(10) Patent No.: US 7,066,299 B1
(45) Date of Patent: Jun. 27, 2006

(54) PORTABLE LADDER SUSPENSION APPARATUS OR A PORTABLE LADDER FOR SUSPENSION OR THE COMBINATION THEREOF

(76) Inventor: Jeffrey John Fleming, 53759 Heritage Ln, New Baltimore, MI (US) 48047

( * ) Notice: Subject to any disclaimer, the term of this patent is extended or adjusted under 35 U.S.C. 154(b) by 0 days.

(21) Appl. No.: 10/819,487

(22) Filed: Apr. 8, 2004

(51) Int. Cl.
*E06C 5/00* (2006.01)
*E06C 7/42* (2006.01)

(52) U.S. Cl. ..... 182/127; 182/107

(58) Field of Classification Search ..... 182/127, 182/106, 107, 214, 129; 248/210, 238
See application file for complete search history.

(56) References Cited

U.S. PATENT DOCUMENTS

| | | | | |
|---|---|---|---|---|
| 2,256,452 | A | 9/1941 | Marshall | |
| 4,211,306 | A | 7/1980 | Brenner | |
| 4,408,680 | A | 10/1983 | Ross | |
| 4,431,082 | A | 2/1984 | Bott | |
| 4,615,412 | A | 10/1986 | Clark | |
| 5,046,582 | A | 9/1991 | Albrecht | |
| 6,029,774 | A | 2/2000 | Cothern | |
| 6,105,722 | A * | 8/2000 | Taylor | 182/107 |
| 6,250,425 | B1 | 6/2001 | Barnes | |
| 6,264,222 | B1 | 7/2001 | Johnston et al. | |
| 6,357,548 | B1 | 3/2002 | Boyd | |
| 6,378,654 | B1 | 4/2002 | Ziaylek | |
| 6,394,229 | B1 * | 5/2002 | Hastreiter | 182/107 |
| 6,533,069 | B1 | 3/2003 | Couillard | |
| 6,578,665 | B1 | 6/2003 | DeBaca et al. | |
| 6,619,428 | B1 * | 9/2003 | Ellis | 182/106 |
| 6,739,349 | B1 * | 5/2004 | Kastenschmidt et al. | 182/106 |

FOREIGN PATENT DOCUMENTS

| | | |
|---|---|---|
| EP | 1087098 | 3/2001 |
| FR | 2729900 | 1/1995 |
| FR | 2828522 | 2/2003 |
| GB | 623906 | 5/1949 |
| GB | 1530117 | 10/1978 |
| GB | 2360315 | 9/2001 |
| GB | 2384812 | 8/2003 |
| GB | 2386920 | 10/2003 |
| JP | 9240375 | 9/1997 |
| JP | 2002274270 | 9/2002 |
| WO | WO 03100204 | 12/2003 |

OTHER PUBLICATIONS

McMaster-Carr Supply Co. Catalog #108, p. 1935, "hook top ladder" pn 8100t31 no month or date available.

* cited by examiner

*Primary Examiner*—Hugh B. Thompson, II

(57) ABSTRACT

A ladder suspension bracket releasably receives and suspends a portable ladder for use, storage, and transportation if on a vehicle (FIG. 1, FIG. 7) comprising of a receiving bracket (FIG. 4, or FIG. 8) and a lower distance maintenance bracket (FIG. 5, or FIG. 9) optionally pivotable (45, 46) to hold step ladder substantially away from the ascension surface (49) or horizontal (5) as required for the ladder type. Bracket is configured such that ladder can easily be released of suspension mode (FIG. 7, FIG. 2) and used independent of this mounted position (FIG. 3). In addition to the claim of such a bracket a ladder having intentional configuration (2) to provide for suspension is also claimed, as is the combination thereof.

1 Claim, 8 Drawing Sheets

1
2
3
4
5
6
7
8
9
10
11
12 figure 8
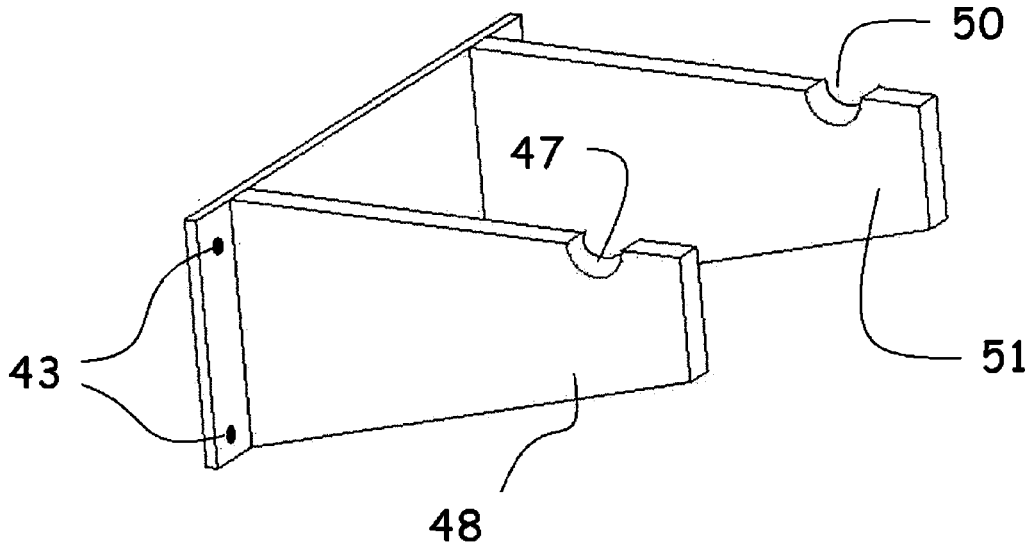
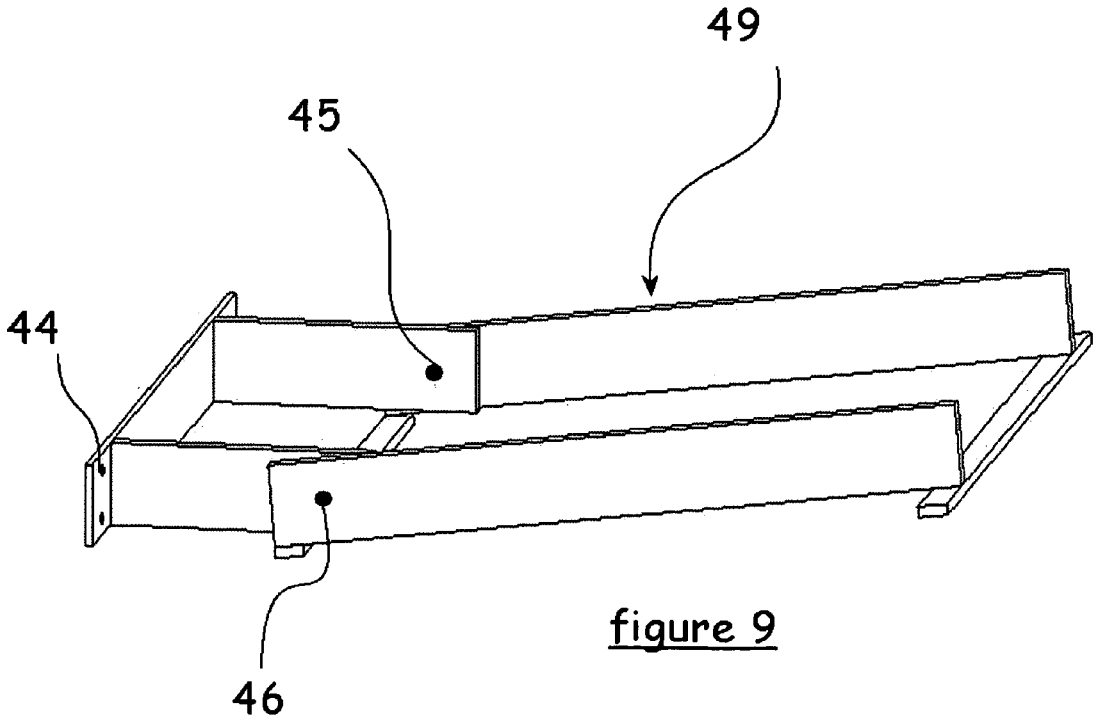
figure 9

PORTABLE LADDER SUSPENSION APPARATUS OR A PORTABLE LADDER FOR SUSPENSION OR THE COMBINATION THEREOF

CROSS-REFERENCE TO RELATED APPLICATION none

FEDERALLY SPONSORED RESEARCH none

SEQUENCE LISTING OR PROGRAM none

TECHNICAL FIELD OF THE INVENTION

This invention relates to a support apparatus for a portable ladder. More particularly an apparatus capable of suspending a portable ladder adjacent a surface adequately for human ascension, storage, and transportation (if on a vehicle) while additionally facilitating use of the portable ladder independent of suspension. Also included is an optional portable ladder constructed specifically for this purpose, as well as the combination of a support apparatus and ladder.

BACKGROUND OF THE INVENTION

Ladders are a very integral part of our society, such a simple device, they have been around for thousands of years and can today be found at just about any household in much of the world, as well as any factory, ship, on the back of recreational vehicles, and on the roof of many work trucks. Yet new forms and functions for ladders are being developed still. There are permanent ladders suspended by being fastened to a surface like a wall of a building, portable extension type ladders that are supported on the ground and lean against a surface, or portable self stabilizing ladders having collapsible pivotal props or more commonly known as a step ladder that also rest on the ground. What isn't available until now is a combination of a portable ladder and fixed suspended ladder, or rather a portable self supporting ladder that can optionally be suspended simulating a permanent type ladder.

The portable ladder as referenced throughout this document includes a ladder of rigid construction that can be easily carried by one person of normal dexterity and the ladder is self supporting, intentionally usable for human ascension by resting the bottom of the stiles (and pivotal props if included) on a surface such as the ground. No other vertical support is required during independent use, although a portable ladder without a prop will require a surface to lean against during use.

It will be of great public convenience and safety to have available a suspended portable ladder on the back of an rv (recreational vehicle) for example, that would allow access to the roof of the rv and also provide for storage and transportation of the ladder, yet have the portable ladder mounted using an apparatus that would make it simple to remove the ladder and use it independent of the attached mode, to wash a window or fix a light, hang a clothes line or hammock. As opposed to precariously standing on tables or chairs to accomplish such tasks. Another potential embodiment would be for a technician fixing a large metal working machine in a factory whose control components are on top of a moving portion of the machine. If a portable ladder was stored using the apparatus on the moving column of the machine the technician could readily have access to those controls or additionally un-attach the affixed portable ladder for vertical access to another part of the machine without needing to hunt down a portable ladder, promoting efficiency and good co-worker relations. Similarly in a residence, instead of a permanent drop down type attic ladder, this apparatus would permit not only ladder storage, but also access to the attic if mounted adjacent the attic access ceiling hole present in many homes. Then additionally the homeowner would have available a portable ladder for changing light bulbs or batteries in smoke detectors at other locations without needing a second ladder, or dangerously standing on buckets or chairs to accomplish such tasks. Yet another benefit of such a device is the fact that mounting a removable ladder as opposed to a non-removable one would not require extensive consideration of placement because if an access panel or in the case of a vehicle if an engine compartment access door was blocked, the ladder could be easily removed providing access of the door or panel. Furthermore if it was desired to prevent access to an elevated area this device could permit removal of the ladder so no such access was available, then install the ladder when access was required.

There is an overwhelming array of art generally referred to as ladder supports that hold the top of an extension ladder away from a desired surface for access around building overhangs or to hold a worker away from the surface making it easier to work such as U.S. Pat. No. 4,615,412, or GB2386920. Some of these types are referred to as safety devices because they are fastened to the structure and hold the ladder from sliding sideways such as U.S. Pat. No. 2,256,452, U.S. Pat. No. 6,578,665, and W003100204. A few go a little further like GB1530117, EP1087098, GB623906, U.S. Pat. No. 6,533,069, U.S. Pat. No. 6,029,774, and attempt to prevent the ladder from falling away from the wall. But none of these suspend the ladder off of the ground. The bottom of the ladder must make contact with the ground for support which would be a problem if the ground was not level, soft, unstable or even moving such as on a vehicle. Also if space was an issue, placing the feet of the ladder at a substantial distance of the surface may be hazardous or not possible. If an attempt was made to suspend a ladder in one of these referenced devices, none of them have a means of holding the lower portion of the ladder at a distance of the wall duplicating the upper distance, so during use the suspended ladders incline angle would be dangerous. Your feet would be closer to the surface than your torso, you would be trying to climb while gravity would be pulling you backwards. Not to mention the risk of failure of the attachment as it was not intended to support the complete weight of a ladder and user. It was also concerning to realize the safety devices that prevent ladder movement require a non braced unsafe ladder to be used for installation of the invention.

U.S. Pat. No. 4,211,306 does suspend the ladder properly during use and the ladder sections are removable, but this is a fire escape device and the removed ladder section must be stored near the mounting bracket. This ladder bracket combination does not provide a portable ladder but rather a ladder section that can only be used if attached to it's mating bracket, it is not usable away from the mounted position. Additionally, if someone foolishly attempted to use the ladder section as a portable ladder and a fire occurs, the ladder would not be present to perform it's stated purpose.

Another prior art consideration was a "hook-top" ladder that hangs on hooks integrated into the top of the ladder. These are readily available at many industrial supply companies such as McMaster(mcmaster.com, search "hook top ladder"). This type of ladder is suspended over walls by means of hooks integrated into the top of the ladder, but does not provide safe use unless in the hung configuration, this is not a portable ladder as referred herein. Also all of these devices are meant only for use during incline and none provide a suitable storage location for a ladder when it is not in use.

Similarly there is also a vast array of vehicle mounted ladders such as U.S. Pat. No. 4,245,716, U.S. Pat. No. 5,046,582, U.S. Pat. No. 6,264,222, U.S. Pat. No. 6,378,654, GB2384812, but these devices lack in their ability to be removed, so they can't be used at other locations, they are not portable. GB2360315, JP2002274270, U.S. Pat. No. 4,431,082, FR2729900, JP9240375 are all examples of vehicle ladders that are removable, but none permit the use of the ladder other than when mounted to the vehicle. Again, they are not portable ladders as referred herein. If vertical access is required at a different location other than the mounted location an additional ladder would be needed or the person would need to improvise using a box, or bucket, or other dangerous means. Also these ladder support methods do not provide a storage or transportation location for the ladder in the mounted usable configuration. If using one of these ladders the operator would need to install the ladder for use, then remove it and store it for transportation, then re-install it for use again, a very inconvenient proposition.

Inventions U.S. Pat. No. 6,250,425, U.S. Pat. No. 6,357,548, U.S. Pat. No 4,408,680 are also vehicle mounted portable ladder support devices, and although they support a portable ladder for use they do not suspend the ladders nor do they provide for storage or transportation in this usable position. The ladders must be removed or re-configured during vehicle movement then set up again at the new location. Another concern with these devices is the fact that the method of support is such that the ladders are cantilevered, not being supported properly for their design. During use a lot of stress is placed on the ladders stiles at the locations where the stiles are supported by these devices, so much leverage could cause the ladders to fail, or break near these contact points causing serious damage and injury.

The dual location ladder of FR2828522 is a very nice idea, although it isn't a ladder suspension apparatus, nor a portable ladder, but rather a ladder that pivots and is supported on the ground to be used at only the two locations provided, namely the bunk area and the rear of the recreational vehicle. With space being of value in a recreational vehicle, storage and transportation of the ladder inside the vehicle may not be desired. Also, often such bunk ladders are not taken during trips if the occupants won't be using the bunk, or children who could be lifted by a parent will be using the bunk area. But without the ladder, roof access isn't possible. And because suspension means are not provided the ladder can't be transported outside the vehicle. Additionally, this is only for a class c style rv with a bunk overhead. Many rv's have no need for a bunk ladder, but do need access to the roof as well as a portable ladder for other tasks which this device will not accommodate.

SUMMARY

As acknowledged, the research of this art has led to many variations of ladder support devices. While all the reviewed prior art was mostly practical for it's intended purpose, none exists that was capable of suspending a portable ladder adjacent a surface adequately for use and storage while additionally facilitating use of the portable ladder independent of suspension.

BRIEF DESCRIPTION OF THE DRAWINGS

The accompanying drawings illustrate in whole and part several embodiments of this invention, and along with the description serve to explain the principal of this invention. These drawings are intended to help clarify the spirit of this invention and do not limit this invention to only include the disclosed embodiments.

FIG. 6 is the modified upper bracket that has been shortened in FIG. 6.

FIG. 8: A perspective view of the upper support bracket as disclosed in the third embodiment discussed in the detailed description.

FIG. 9: A perspective view of the lower pivotable version spacing bracket as disclosed in the third embodiment discussed in the detailed description.

DETAILED DESCRIPTION

In a first embodiment of this device several parts will be fabricated to create an assembly. The purpose of this version is to permit access to the roof of a recreational vehicle (rv). Due to exterior environmental exposure a weather resistant rigid material is recommended, and it needs to be strong enough to safely support a person. When fastening any portion of the assembly, any fasteners, adhesives, welds, or other attachment means must be strong enough to support human use and be unaffected by weather or environmental exposures. Environmental exposures may also require the use of sealants or other such invasive prevention methods.

Figure 1:
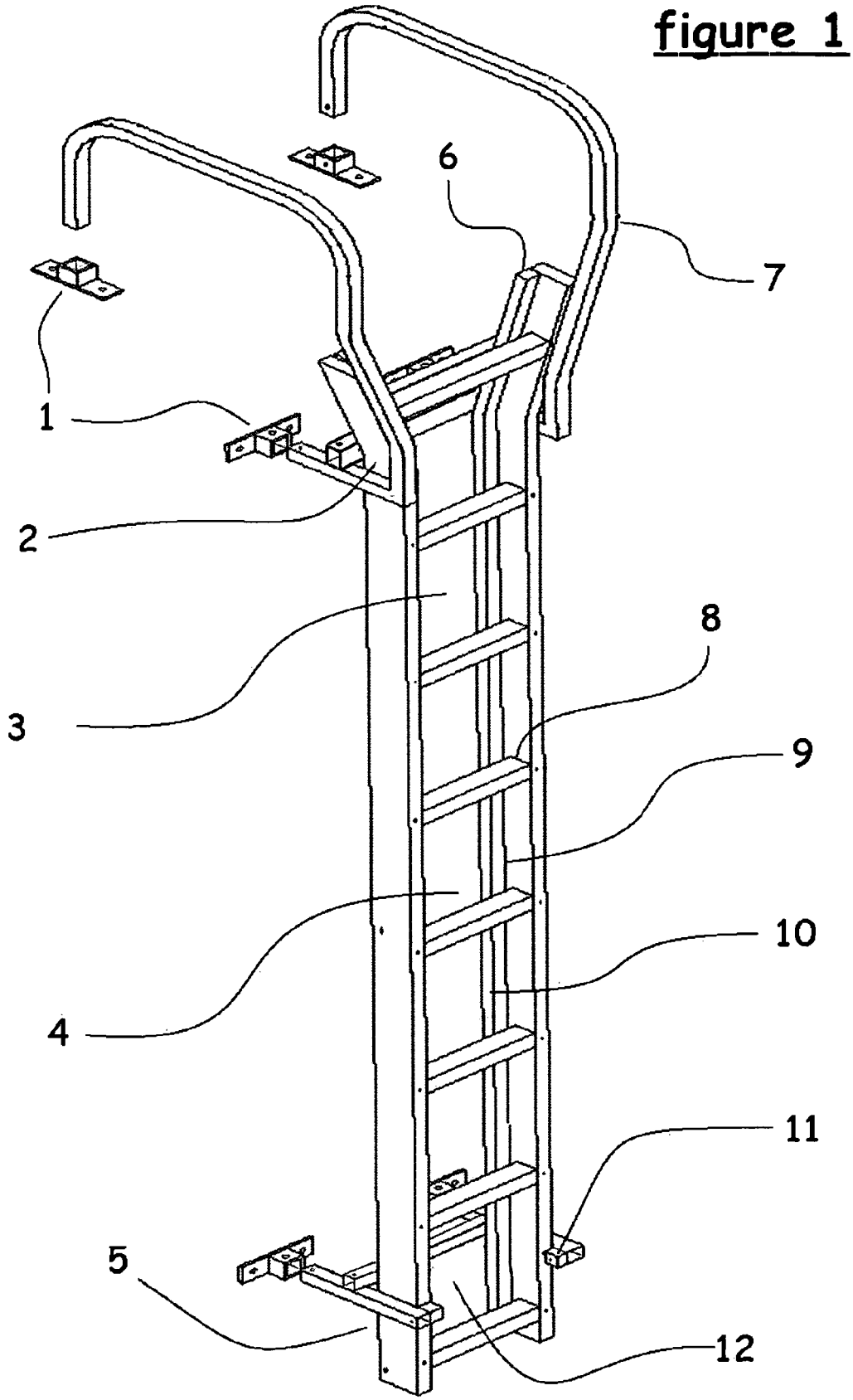
FIG. 1: A perspective view of the complete first preferred embodiment, the ladder is installed in the bracket, for visual clarity the flanges are not inserted onto the assembly.
Figure 2:
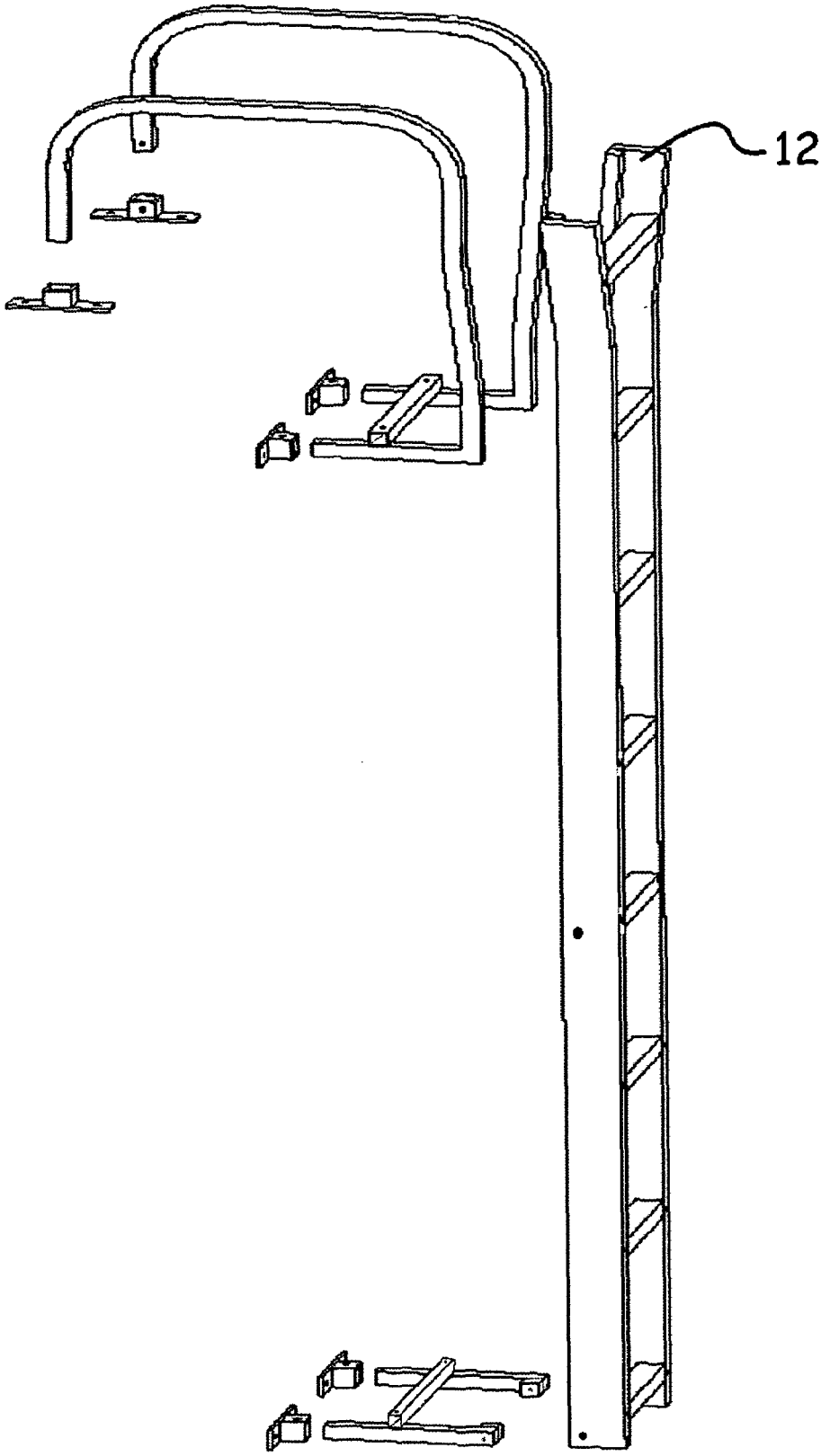
FIG. 2: A perspective view of the complete first preferred embodiment at a slightly more side view than FIG. 1 to illustrate the ladder's location just prior to insertion into the bracket.
Figure 4:
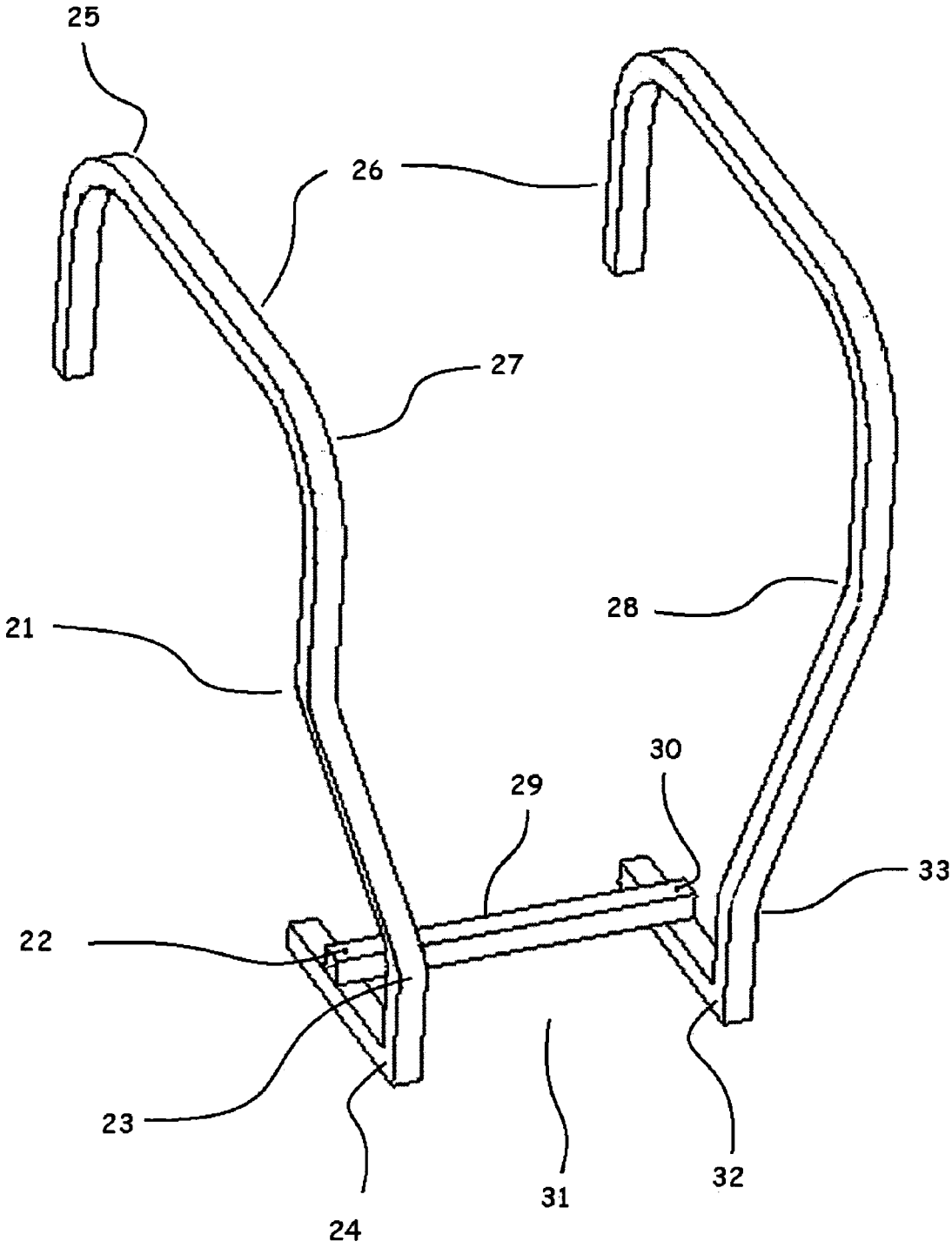
FIG. 4: A perspective view of the upper bracket assembly without the ladder inserted as described in the first preferred embodiment.

The upper support bracket (FIG. 4) includes two formed members (26), spaced using a cross brace (29), and attached to the surface using flanges (1). Begin creating turns in your material to similarly duplicate the formation of the upper support brackets (FIG. 4). More specifically creating a first 90° turn (25) at a distance from the end of your material matching the desired height above the roof of the vehicle. A second 90° turn (27) in the same direction at a distance from the first bend equaling the desired distance from the roof's mounting location to the rear edge of the vehicle plus the desired standoff distance of the ladder from the rear of the vehicle. The upper support bracket is formed by creating another turn of approximately 20°(21) perpendicular to the previous two bends at a distance close to the plane of the roof of the vehicle if the bracket were mounted. The second bracket will have a −20° turn (28) at this same distance. At a distance greater than the desired angled portion of the ladder legs (14) the inverse of the previous turn must be fabricated (23, 33). Next it will be necessary to create a square non-radiused 90° turn (24, 32) in the same direction as the first two 90° turns (25, 27). A cross member (29) of similar material properties will be provided and affixed to the these two braces (30, 22), keeping the closest distance between the fabricated braces (31) slightly further apart then the desired width of the parallel portion of the ladders stiles (3). The ladders parallel stiles must fit between the narrowest portion of this brace. This cross member will provide for entrapping the ladder when the ladder is inserted into the bracket (FIG. 1), so the cross member should be spaced from the vertical portions of the fabricated bracket (21) accordingly. This portion of this embodiment can be affixed to the surface of the vehicle by use of flanges (1) having similar material requirements as previously requested and providing a bracket receiving method as well as a method to attach to the vehicle surface.

Figure 3:
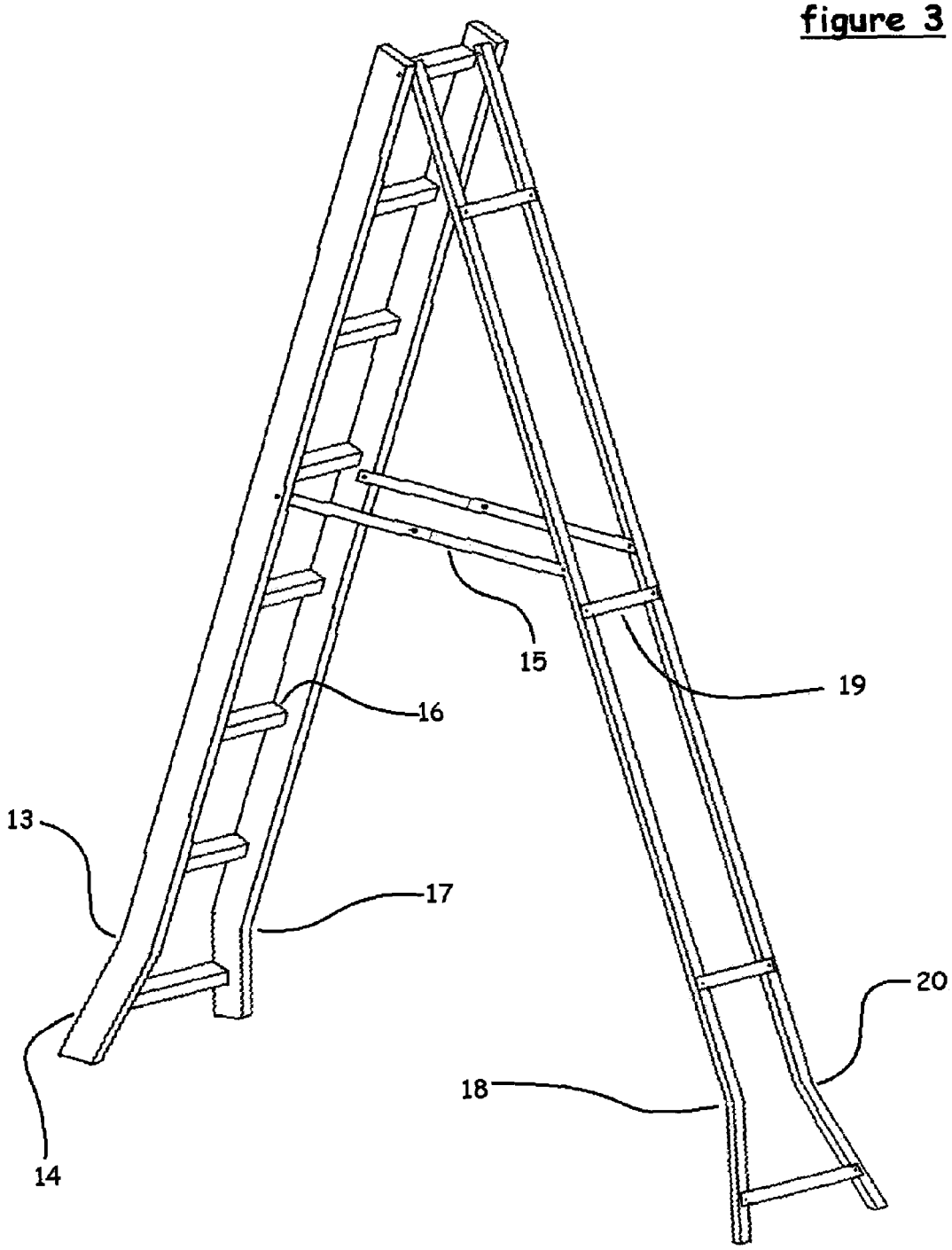
FIG. 3: A perspective view of the portable step ladder described in the first preferred embodiment. This is the view of the ladder when used independent of any support bracket.

The next portion of this embodiment will require the construction of a step type portable ladder (FIG. 3). The ladder is typical in that it includes multiple rungs, side stiles, and a pivotal prop that includes braces and a spreader. The material and any fastening means should be of strength adequate for safe human use of the finished device and of resistance to any exposure to the elements as well as being light enough to be carried and manipulated by a person of average dexterity. One of the unique requirements for this embodiment of a portable step ladder is the angle created in each stile (13, 17). This angle will provide stability when used as a step ladder or additionally permit the ladder to be optionally suspended in the previously fabricated bracket (2). The angle should be about 20° and must match the angle of the bracket assembly (23, 33). This turn is located at least 2 inches from the bottom of the stile for every foot of total stile length (a 6 foot ladder would have the turn 12 inches above the foot of the stile). Also the pivotal prop should possess the same angle (18, 20). Additionally the prop must be of assembled width to fit between the ladder stiles when completed (6, 10). To permit the prop to rest between the stiles when closed the rungs need to be of proper size and displaced to the front edge of the stiles (8, 16). Any prop bracing (19) must be positioned such that it doesn't interfere with a users hands or feet when the prop is closed and the ladder is placed in the bracket (4). The final consideration is the spreader (15) must not interfere with the prop's closed position so it is recommended for this embodiment that the width of the assembled prop be narrow enough to permit the spreaders to fold between the inside of the stiles and the outside of the prop (9). It is advised that the height of this ladder be approximate the height from the bumper of the vehicle to the top of the insertion portion (7) of the upper bracket.

Figure 5:
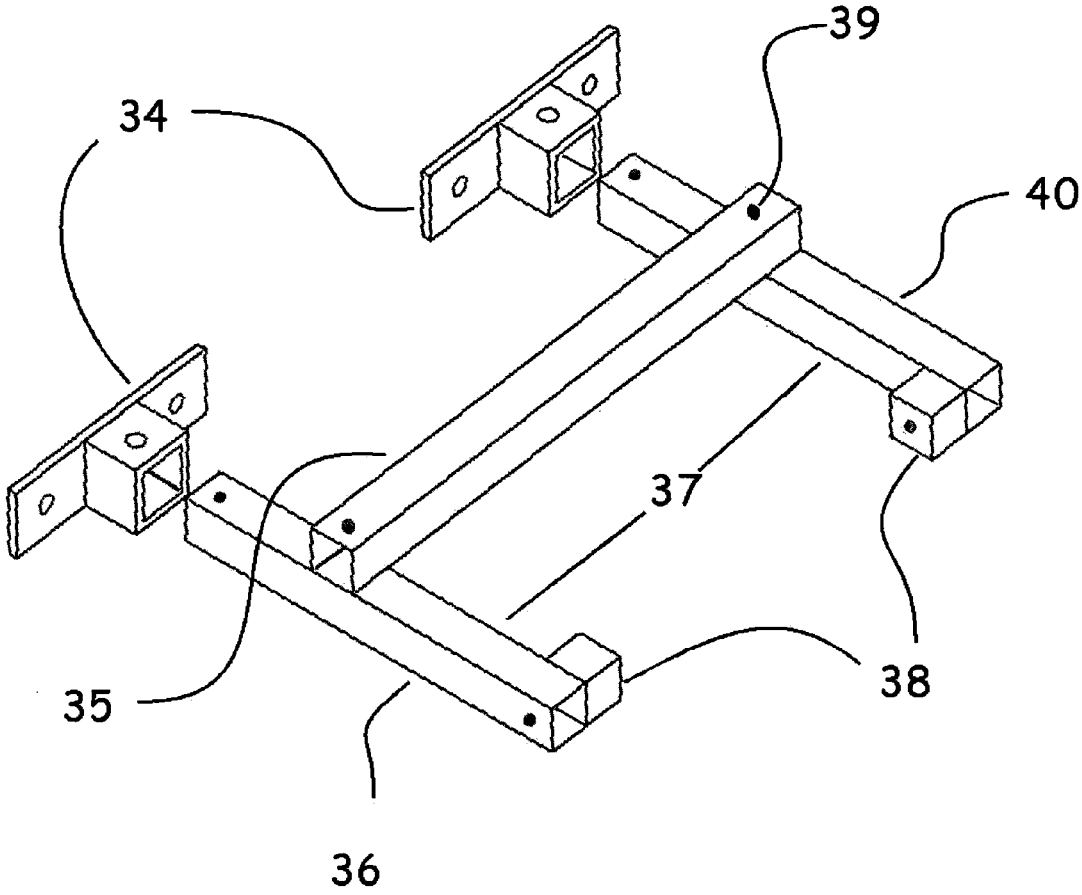
FIG. 5: A perspective view of the lower bracket assembly without the ladder inserted as described in the first preferred embodiment.

The final piece required for this embodiment assembly is the lower bracket (FIG. 5). Again material and fastening considerations remain the same. A plurality of surface protruding members (36, 40) will be required. These members can be attached to the surface using flanges (34) having the required characteristics as disclosed during the upper brackets discussion, including the separation requirement of slightly more than the parallel portions of the ladder stiles (12), and of length required to maintain the ladder approximately vertical when mated to this version of the embodiment (5). A cross brace (35) will also be required of similar material and attached (39) to the members, maintaining the separation distance (37) of the protruding members and the previously requested vertical orientation of the installed ladder. Additionally at the extreme of the protruding members will be required the attachment of retention blocks (11, 38) that will loosely trap and hold the ladder for storage and transportation.

There is now an apparatus capable of suspending a portable ladder adjacent a surface adequately for use and storage while additionally facilitating use of the portable ladder independent of suspension and an accompanying ladder. The ladder can be used as any step ladder. By opening the pivotal prop you can rest the ladder on suitable ground and climb the ladder for vertical access, then you can close the pivotal prop, turn the ladder upside down, and with the rungs toward you and the folded prop away from you, you can lift the ladder over the opening in the upper bracket and slide the stiles down into the resting suspended position entrapping the stiles in the lower bracket then climb the ladder in this suspended mode for vertical access.

For security purposes and to prevent unauthorized removal of the ladder a locking mechanism could easily be included and could be as simple as a cable and combination lock. Or in an alternate embodiment a locking method could be incorporated into the assembly. For an example by drilling a hole horizontally through the protruding member of the lower bracket and the stile of the ladder when suspended, a locking clevis pin could easily be inserted through these holes locking the ladder to the lower bracket.

Figure 6:
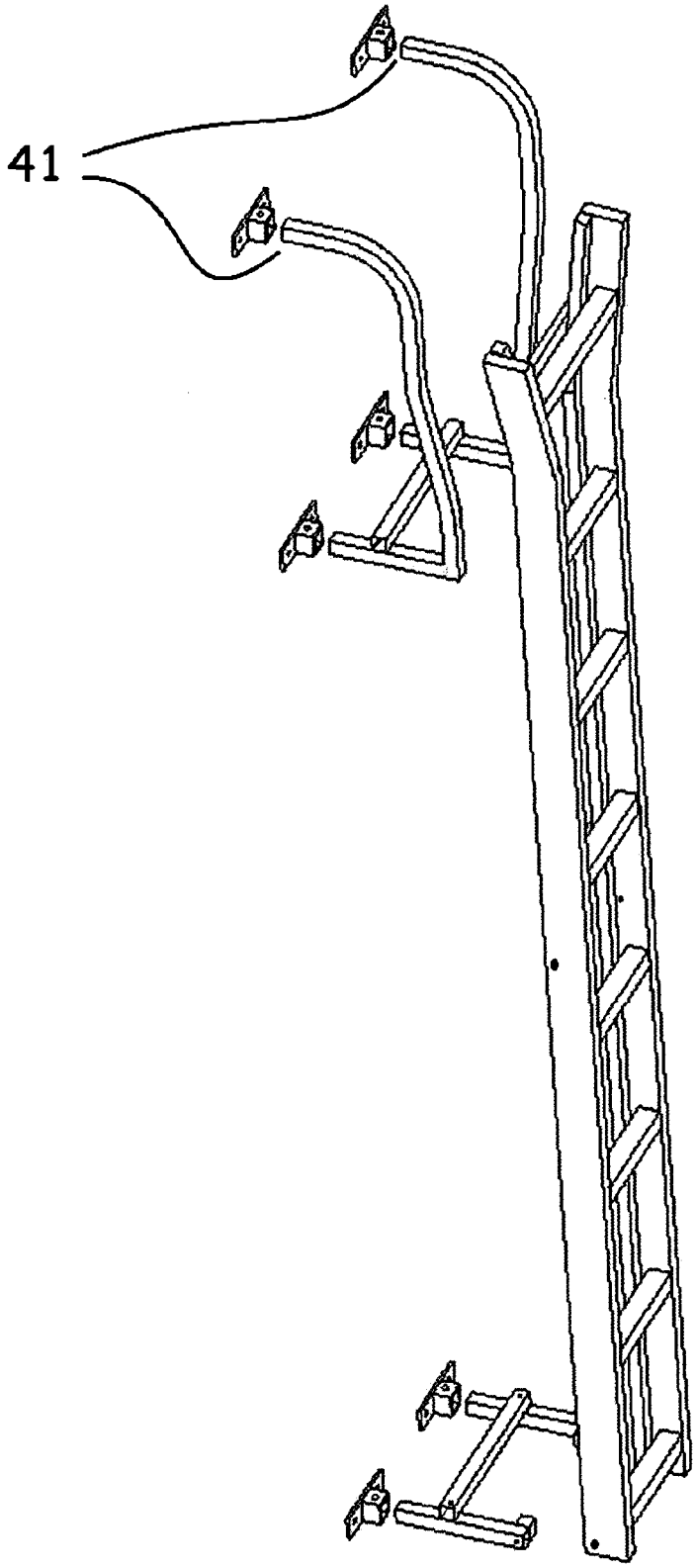
FIG. 6: A perspective view of the complete second preferred embodiment as discussed in the detailed description. Notice the only difference between FIG. 2

A similar embodiment could be used on a metalworking machine as previously discussed. Or if the upper bracket was cut after the first bend (41), it could be attached to a vertical wall and used for attic access for example (FIG. 6).

Figure 7:
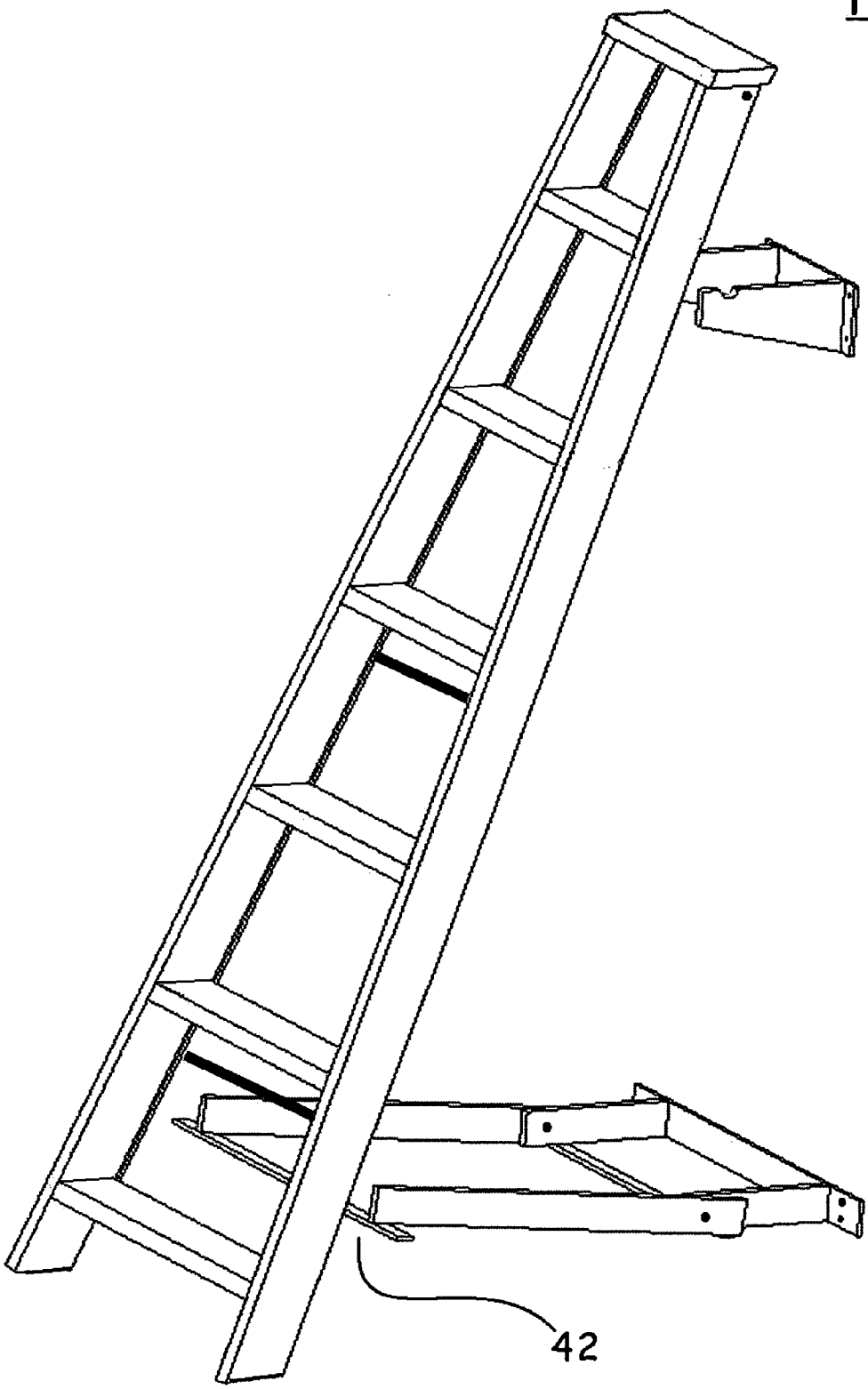
FIG. 7: A perspective view of the complete third embodiment discussed in the detailed description. A standard step ladder is shown just prior to insertion onto the support brackets.

A much simpler embodiment (FIG. 7) using an existing portable extension or step ladder would be an apparatus containing receiving protrusions (47, 51) that are affixed (43) to a suitable surface and configured to hold a portable ladder (47, 50). Additionally a lower distance maintenance method (49) will be required. If a step ladder is being used it should be necessary to hold the lower portion of the ladder substantially away from the surface (42) duplicating the incline angle when the step ladder is independent of any support device and the pivotal prop is used. This is because the standing surface of a step ladders rungs are generally not perpendicular to the stiles but placed at a angle. In this embodiment example the lower support bracket is affixed to an appropriate surface (44) and has a pivot (45, 46) to optionally achieve this substantial distance during use, alternately permitting the ladder to be stored vertical when not used. This similar apparatus could be used with an extension ladder but the rung orientation of an extension ladder does not require that the ladder be held other than vertical during use so the pivot method wouldn't be required.

Other embodiments may integrate this invention partially or completely into a ladder, or the support means may be part of or integrated into another structure such as a facia, bumper, railing, or hull, for a few examples, and could be constructed of metal, plastic, or fiberglass or any suitable material.

There has been disclosed in detail a preferred embodiment, and additionally several other variations, and mentioned other embodiments. It should be clear that this invention has a vast array of configurations and applications. Thus it should be easy for recipients of this disclosure especially those skilled in this art to apply this invention in many situations to receive similar results, and not limit it's application to what was discussed here.

It is important to note by anyone constructing or using any vertical access device that being above a surrounding area is very dangerous. A simple trip while walking on the ground can cause serious injury. This potential for injury escalates greatly when someone is using a ladder. Please be very careful in the construction or use of any ladder. Please be certain that safety is considered and that known safe practices and materials be used at all times. OSHA, ANSII, CE, and other such safety groups are an excellent source for this information and should be referred to prior to use or construction of any ladder.

The invention claimed is:

1. A ladder support bracket assembly comprising:

an upper bracket assembly;

the upper bracket assembly having a pair of upper support bracket members;

each upper support bracket member comprising a first section at an upper end thereof, the first section having a free end adapted to be secured to a work surface mounting assembly and at another end, the first section transitioning into a middle section angled away from the first section and depending therefrom, the middle section transitioning to an L-shaped lower section, the lower section extending in the same direction as the free end and adapted to be secured to another work surface mounting assembly, and an upper cross brace secured to and extending between the lower sections of each upper support bracket member; and a lower bracket assembly;

the lower bracket assembly having a pair of lower support bracket members;

each lower support bracket member at end thereof being adapted to be secured to additional work surface mounting assemblies and having a retaining block at the other end, and a lower cross brace secured to and extending between the lower support bracket members; and wherein when in use, an upper end of a ladder is received between the upper cross brace and the lower sections of the upper bracket assembly, so as to secure the upper end of the ladder in a fixed use position relative to a work surface, and a lower end of the ladder is received between the lower cross brace and the retaining blocks of the lower bracket assembly, so as to secure the lower end of the ladder in the fixed use position relative to the work surface.

* * * * *